US005364384A

United States Patent [19]

Grabenkort et al.

[11] Patent Number: 5,364,384

[45] Date of Patent: Nov. 15, 1994

[54] FLEXIBLE CONTAINER WITH INTERGRAL PROTECTIVE COVER

[75] Inventors: Richard W. Grabenkort, Barrington; Thomas P. Joyce, Libertyville, both of Ill.

[73] Assignee: Abbott Laboratories, Abbott Park, Ill.

[21] Appl. No.: 77,754

[22] Filed: Jun. 14, 1993

Related U.S. Application Data

[63] Continuation of Ser. No. 636,635, Dec. 31, 1990, abandoned.

[51] Int. Cl.[5] ..... A61J 1/05

[52] U.S. Cl. ..... 604/408; 604/403; 604/411

[58] Field of Search ..... 604/403, 408, 410, 411, 604/415, 317, 321, 322, 326

[56] References Cited

U.S. PATENT DOCUMENTS

| | | | |
|---|---|---|---|
| 3,313,439 | 4/1967 | Robinson | 609/415 |
| 4,198,972 | 4/1980 | Herb | 609/408 |
| 4,365,629 | 12/1982 | Pert et al. | 604/408 |
| 4,467,588 | 8/1984 | Carveth | 604/410 |
| 4,479,989 | 10/1984 | Mahal | 604/415 |
| 4,496,362 | 1/1985 | Leurink | 604/408 |
| 4,596,573 | 6/1986 | Donnan et al. | 604/415 |
| 4,637,934 | 1/1987 | White | 604/415 |
| 4,675,019 | 6/1987 | Bellhouse et al. | 604/408 |
| 4,917,684 | 4/1990 | Yasumura | 604/408 |

*Primary Examiner*—Sam Rimell

*Attorney, Agent, or Firm*—A. Nicholas Trausch

[57] ABSTRACT

A flexible container for medical solutions is provided that includes first and second film sheets sealed together along multiple sides so as to form a pouch having an open end. An end port member is located between and sealed to the first and second film sheets near the open end of the pouch to enclose the interior of the container. The end port member has at least one integrally-formed access port for fluid communication between the exterior and the interior of the flexible container. A portion of the first and second film sheets extend beyond the end port member and are sealed together along the edges of the extended portions so as to form a protective cover for the access ports. The protective cover is detachable.

6 Claims, 1 Drawing Sheet

FLEXIBLE CONTAINER WITH INTERGRAL PROTECTIVE COVER

This application is a continuation of U.S. application Ser. No. 07/636,635, filed Dec. 31, 1990, now abandoned.

BACKGROUND OF THE INVENTION

This invention relates to a flexible container for medical use. More specifically, the invention relates to a flexible container for medical solutions that may be used without the need for enclosing the flexible container in a separate overwrap container.

Disposable plastic containers have many advantages over previous medical storage containers, including resistance to breakage, light weight, occupy less space and are easier to handle. It is therefore often desireable to use disposable plastic bags rather than glass bottles or other containers for storing and dispensing certain medical solutions. The disposable plastic containers are most frequently made of polyvinyl chloride or ethylene vinyl acetate copolymer. Flexible bags are frequently formed by two rectangular sheets of plastic material flat-welded to each other on four sides. However, most flexible plastics such as the above described heat weldable plastic materials tend to have a significant degree of water vapor and gas permeability.

When disposable medical bags are formed, appropriate inlet and outlet ports are provided in the welded sides. The two sheets and the four welded sides define a reservoir whose volume is zero before it is filled under pressure through an inlet or port. After the reservoir is filled, the inlet is sealed and the plastic container is steam sterilized such as by an autoclave cycle. Inlet and outlet ports are typically pre-sterilized by radiation in order to minimize the duration of the steam sterilization cycle.

Since the medical solution in the containers may be stored in the pharmacy or hospital for extended periods, water vapor and gas permeation through the plastic material is a great concern. Thus for disposable plastic containers for medical use, a water vapor and/or gas impermeable overwrap container is needed to completely surround the flexible container. The overwrap is typically a high density polyethylene, a foil or other high barrier type material.

Recent concern about the disposal of medical waste such as by incineration has created a desire to limit the amount of waste material, such as the packaging, used in connection with medical products. Also it is preferred to continue using certain plastic materials for medical products.

U.S. Pat. Nos. 4,198,972 and 4,183,434 show one type of flexible storage bag wherein the access ports are hermetically enclosed by a protective closure that is integral with the bag material. However, the closure around the ports are peelably separable to expose the ports.

U.S. Pat. No. 3,520,471 discloses a sealed flexible container having sealed end compartments enveloping open fluid conduits. The conduits which are sealed during assembly of the end compartments can later be opened by pinch pressure.

U.S. Pat. No. 4,559,053 discloses a flexible container having a semi-rigid frame. The connecting tubes which traverse the frame are exposed and are not enclosed by the extending parts of the film sheets.

U.S. Pat. Nos. 4,479,989 and 4,596,573 disclose flexible containers having a separately formed rigid end port members. The end ports are exposed and are not enclosed by the extending parts of the film sheets.

Thus there is a desire and a need for a flexible solution container that can be conventionally manufactured and sterilized and yet maintain the initial formulation of the medical solution and the sterility of the access ports for extended periods of time without the need for a completely separate overwrap container.

There is a further need for a flexible container having an integral protective cover that is detachable so that the sterilized ports may be accessed. There is also a need for such a flexible container that minimizes the amount of waste material to be disposed, yet is still simple in design, reliable and inexpensive to manufacture.

SUMMARY OF THE INVENTION

A flexible container for medical solutions is provided that includes first and second film sheets sealed together along multiple sides so as to form a pouch or solution chamber having an open end. An end port member is located between and sealed to the first and second film sheets near the open end of the pouch to completely enclose the interior of the container. The end port member has at least one, and preferably two, integrally-formed access ports adapted for fluid communication between the exterior and the interior of the flexible container. A portion of the first and second film sheets extend beyond the end port member and are sealed together along the edges of the extended portions so as to form a protective cover for the access ports.

In accordance with another feature of the invention, the protective cover is detachable so as to allow easy access to the ports. Further, a tear line can be formed on at least one of the sheets along the transverse portion that is sealed to the exterior surface of the end port member so as to maintain seal integrity or alternatively a tear line can be formed near the transverse seal so as to propagate and direct the tear when the protective cover is detached.

DESCRIPTION OF THE DRAWINGS

A better understanding of the flexible container for medical solutions of the present invention will be had by reference to the drawings wherein.

DESCRIPTION OF THE PREFERRED EMBODIMENT

Figure 2:
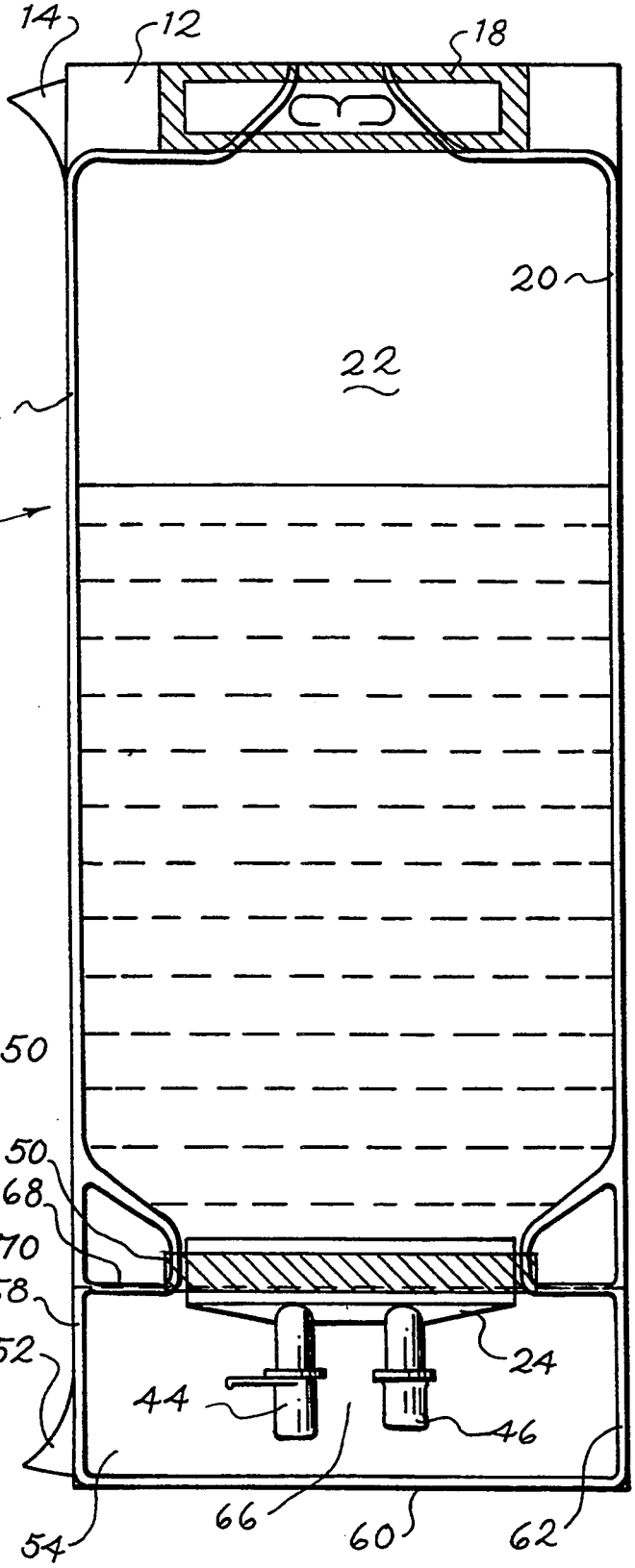
FIG. 2 is an elevational view of a large flexible container in accordance with one embodiment of the invention.

In the embodiment of the invention illustrated in FIG. 2, the flexible container 10 is preferably constructed of two identical film sheets 12 and 14 which are autoclavable, chemically inert and physically compatible with the medical solutions to be stored, and which exhibit water vapor and/or gas permeation barrier properties sufficient to avoid the need for a separate overwrap container. Preferably the sheets are a multilayered (laminated or coextruded) plastic material such as an interior layer of a heat deformable material such as an elastomer modified propylene/ethylene copolymer bonded to an exterior layer such as a polyamide or polyamide copolymer.

The film sheets 12 and 14 are joined together by applying heat and pressure so as to form multiple weld seals along sides 16, 18, and 20 for example. The boundary seals form a pouch or solution chamber 22 having an open end.

The interior layer of the multi-layer film sheets 12 and 14 melt at a lower temperature than the exterior layer and thus readily welds to the interior layer of the other sheet. The exterior layer of the multi-layered film sheet acts as a release sheet to allow physical contact for heat sealing. The exterior layer also adds strength to the flexible container.

Figure 1:
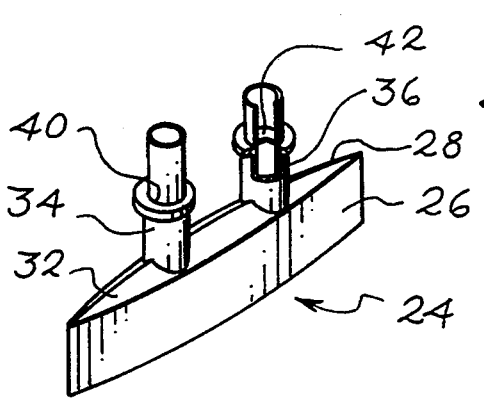
FIG. 1 is a perspective view of a end port member constructed in accordance with one aspect of the invention.

A semi-rigid or rigid end port member 24, as best seen in FIG. 1, is sealed between the sheets 12 and 14 near the open end of the pouch to thereby completely enclose the interior of the flexible container and define a fluid reservoir and vapor space reservoir.

Port member 24 is preferably constructed of a medical grade plastic material similar to or compatible with the described interior layer of the two multi-layered film sheets 12 and 14. The end port member is preferably molded and includes side surfaces 26 and 28 which are preferably arcuate and joined together at their ends. In the preferred embodiment the top surface 32 of the port member 24 thus has a boat-shape. Other suitable configurations include oval or diamond shapes.

The port member 24 also includes at least one (two are shown) integrally-formed ports, 34 and 36 for example, communicating with the interior of the flexible container. The ports are constructed in a conventional and well-known manner so as to have pierceable diaphragm portions, 40 and 42 for example, which will provide fluid sealing and access to the interior of the container for conventionally known access devices such as piecing pins or syringe needles. Redundant and removable seal caps 44 and 46 are also provided to insure the ports, which are pre-sterilized by radiation, remain sterile prior to use.

As best seen with reference to FIGS. 1 and 2, the side surfaces, such as 26 and 28 for example, of the port member 24 are sealably joined to the interior layer of the respective film sheets 12 and 14 along a transverse portion 50 of the film sheets by a welding process.

An integral and continuous portion of each film sheet, designated 52 and 54 respectively in FIG. 2, extends beyond the end port member 24 and the transverse seal portion 50. The extending portion of both film sheets is sealed together along the edges 58, 60, and 62 so as to form a sealed protective cover 66 for the access ports of the end port member. Since the cover 66 is constructed from the multi-layer film sheet of the flexible container, the barrier properties of the film sheet extensions 52 and 54 provide the necessary isolation for the access ports, 44 and 46 for example, that overwrap containers provide for known flexible containers.

The cover 66 is preferably detachable so as to allow easy access to the ports for use. The construction shown in FIG. 2 includes a tear line 68 formed along the transverse seal portion 50 of at least one of the film sheets. The tear line can also be "near" (i.e. offset from) or adjacent the transverse seal portion 50 as shown by tear line 70 in FIG. 3. Preferably, matching tear lines are formed on the opposed portions of both film sheets. To enhance the seal integrity of the tear line, the transverse seal portion 50 may have a width such that the tear line 68 can be formed with welded seal portions on both sides of the tear line. Thus the protective cover 66 can be detached from the flexible container without compromising the seal, while maintaining sterility of the access ports. However, a "sealed" tear line such as 68 is not required to maintain sterility. A tear line such as 70 which is "near" the transverse seal portion 50 of the film will provide substantially the same protection.

Figure 3:
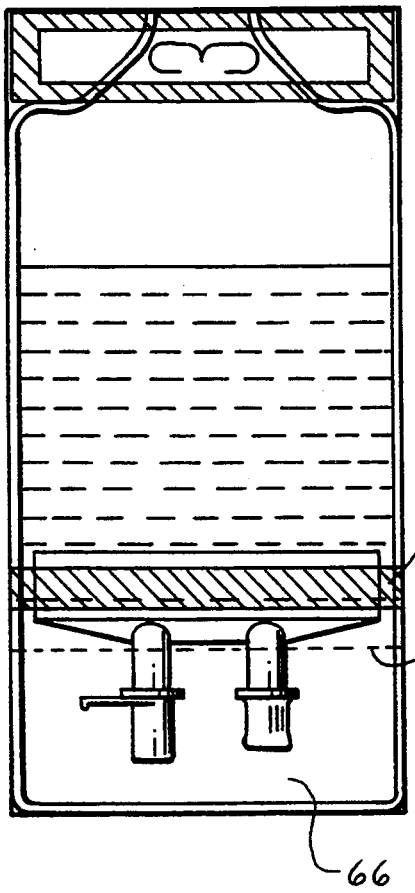
FIG. 3 is an elevational view of a small flexible container in accordance with another embodiment of the invention.

The flexible container embodiment of FIG. 3 is similiar to that of FIG. 2 except the container volume is smaller. However, the same size end port member 24 may be used. Since the transverse dimension is smaller, a different transverse seal configuration is shown.

As can be appreciated from the above description of the invention, the integrally formed protective cover 66 eliminates the need for a separate overwrap container for the flexible container 10, and thus reduces the quantity of material to be disposed. Further the protective cover allows easy access to the ports in a manner that is simple in design, reliable in operation, and inexpensive to manufacture.

The foregoing invention can now be practiced by those skilled in the art. Such skilled persons will appreciate that the flexible container of the present invention is not necessarily restricted to the particular preferred embodiments presented herein. The scope of the invention is to be defined by the terms of the following claims in the spirit and meaning of the preceding description.

What is claimed is:

1. A flexible container for medical fluids, comprising:

a longitudinally extending pouch having an open end, the pouch constructed of first and second multiple layered film sheets, each sheet having concurrent perimeter edges and a bondable interior layer, the interior layers sealingly bonded together along a first portion of the perimeter edges of said film sheets so as to form the pouch;

an end member sealed transversely across the open end of the pouch at an intermediate longitudinal position, the end member sealed to the interior layer of the first and second film sheets to enclosably define a sealed interior chamber of the container, said end member having at least one integrally-formed port constructed and arranged for fluid communication with the sealed interior chamber of the container;

a protective cover constructed of an extension portion of each of said first and second film sheets extending beyond said end member, the interior layers of said extension portions being sealingly bonded together along a second portion of the perimeter edges of said extension portions of the film sheets so as to form the protective cover for enclosing said at least one port of said end member; and means for detaching said protective cover from the container so as to provide access to said at least one port of said end member.

2. The flexible container of claim 1 wherein said end member has two opposed side surfaces that intersect at two opposite edges, and the bondable interior layers of the first and second film sheets are sealed to opposite side surfaces of said end member along a transverse portion of said film sheets at the open end of the pouch.

3. The flexible container of claim 2 wherein said detaching means comprises a tear line formed in the transverse portion of at least one of said film sheets.

4. The flexible container of claim 2 wherein said detaching means comprises a tear line formed in the protective cover adjacent to the transverse portion of at least one of said film sheets.

5. The flexible container of claim 1 wherein each of said first and second multiple layered film sheets further includes a releasable exterior layer.

6. The flexible container of claim 1 wherein said end member is boat-shaped and has two arcuate side surfaces that intersect at two opposite edges, the side surfaces sealed to the first and second film sheets, said end member also having a top surface through which said at least one port extends.

* * * * *